US011065890B2

(12) United States Patent
Song

(10) Patent No.: US 11,065,890 B2
(45) Date of Patent: Jul. 20, 2021

(54) PRINTER

(71) Applicants: SHIN HEUNG PRECISION CO., LTD, Anseong-si (KR); MANGOSLAB CO., LTD., Seongnam-si (KR)

(72) Inventor: Inho Song, Seoul (KR)

(73) Assignees: SHIN HEUNG PRECISION CO., LTD, Anseong-si (KR); MANGOSLAB CO., LTD. I, Seongnam-si (KR)

( * ) Notice: Subject to any disclaimer, the term of this patent is extended or adjusted under 35 U.S.C. 154(b) by 18 days.

(21) Appl. No.: 16/713,147

(22) Filed: Dec. 13, 2019

(65) Prior Publication Data

US 2020/0189296 A1 Jun. 18, 2020

(30) Foreign Application Priority Data

Dec. 14, 2018 (KR) ..... 10-2018-0161716

(51) Int. Cl.
*B41J 29/02* (2006.01)
*B41J 11/00* (2006.01)

(52) U.S. Cl.
CPC ..... *B41J 11/0045* (2013.01); *B41J 29/02* (2013.01)

(58) Field of Classification Search
CPC ..... B41J 11/0045; B41J 3/36; B41J 3/4075; B41J 29/023; B41J 29/13
See application file for complete search history.

(56) References Cited

U.S. PATENT DOCUMENTS

| | | | | |
|---|---|---|---|---|
| 7,059,793 | B2 | 6/2006 | Mori et al. | |
| 2004/0218229 | A1* | 11/2004 | Choi | B41J 29/13 |
| 2011/0146158 | A1* | 6/2011 | Yamada | B41J 29/13 |

FOREIGN PATENT DOCUMENTS

| | | | |
|---|---|---|---|
| JP | 5223854 | B2 | 6/2013 |
| JP | 5265972 | B2 | 8/2013 |
| KR | 1020020018035 | A | 3/2002 |

* cited by examiner

*Primary Examiner* — Huan H Tran
(74) *Attorney, Agent, or Firm* — Novick, Kim & Lee, PLLC; Jae Youn Kim; Jihun Kim

(57) ABSTRACT

A printer includes a main body casing part in which a storage part is formed; a printer head unit installed on the main body casing part; a cover part installed to be openable and closable on the main body casing part; a platen roller unit installed on the cover part to match with the printer head unit; and a hinge means in which a translational movement area and a rotational area are provided so that the cover part is installed on the main body casing part to be opened and closed through the linear movement and the rotational operation.

11 Claims, 18 Drawing Sheets

PRINTER

TECHNICAL FIELD

The present disclosure relates to a printer, and more particularly, to a printer, which may produce a compact and diverse design by improving the opening and closing structure of a printer cover.

BACKGROUND ART

A printer has been continuously developed according to the print media, the printing method, and various customized usage methods. A printer technology is evolving from a printer connected to a computer network to print on a paper medium in an inkjet method to a receipt issuing printer and a label printer as a thermal printer, a 3D printer, a semiconductor or circuit fabrication printer, a post-it printer recently suggested as the office application, and the like.

The size and design element of the printer are becoming a very important factor from the association with a print service model regardless of the technical method of printing. Because the design is a marketing point that determines the commercial success of a product, there is a need for a printer capable of providing a design suitable for a specific application.

Hereinafter, the opening and closing structure of the conventional thermal printer will be exemplarily described based on the structure of the thermal printer disclosed in Japanese Patent No. 5265972. The thermal printer is a type widely used as a POS printer as the use for printing a simple receipt, specification, or the like, and is developed and used as a front feeding type in which the printing paper is drawn out to the front of the printer, a top feeding type in which printing paper is drawn out to the top of the printer, and a hybrid type in which both the front feeding and the top feeding are available.

"The printer with the cutter' disclosed in Japanese Patent No. 5265972 is composed of a casing 2, a platen unit 3 and a main body unit 4, as illustrated in FIGS. 1A and 1B, and the roll paper (R) inserted from an insertion port 2*a* is stored and installed in the casing 2.

The casing 2 has an opening and closing door 6 fixed to be openable and closable via a hinge part 5 and is mounted with the platen unit 3 so that the recording paper (P) may be drawn in and out through the opening and closing operation.

As described above, since the conventional thermal printer has a structure in which the opening and closing door is opened and closed by the hinge part 5 that depends only on the rotational operation, there are limitations in which the position of the hinge part 5 should be positioned within a certain range and the interference between the opening and closing door and the casing, and the like should be considered in order to implement the platen unit 3 as a structure of matching with the main body unit 4 or being separable therefrom.

There are disadvantages in that these structural limitations not only act as a limiting factor in the design, such as the size and shape of the opening and closing door 6 and its related components, but also a compact product may not be implemented because the overall size of the exterior case may not be reduced by the position limitation of the hinge part 5 that should be kept at a certain distance from the main body unit 4.

Further, there is a disadvantage in that there necessarily has a uniform design in a cube form when designing a hybrid type printer capable of both the front feeding and the top feeding of the printing paper due to the structural feature of the opening and closing door operated only by the rotational operation like the above-described conventional thermal printer, thereby lowering merchantability.

RELATED ART DOCUMENTS (Patent Document 1) Japanese Patent No. 5265972 (May 10, 2013) 'PRINTER WITH CUTTER'

(Patent Document 2) Japanese Patent No. 5223854 (Mar. 22, 2013) 'PRINTER'

(Patent Document 3) U.S. Pat. No. 7,059,793 (Jun. 13, 2006) 'PRINTER AND CUTTER'

DETAILED DESCRIPTION OF INVENTION

Technical Problem

The present disclosure is intended to solve the above problems, and an object of the present disclosure is to provide a printer having improved the design limiting factor of a printer cover to produce a compact and diverse design.

Technical Solution

For achieving the object, a printer according to one aspect of the present disclosure includes a main body casing part in which a storage part has been formed; a printer head unit installed on the main body casing part; a cover part installed to be openable and closable on the main body casing part; a platen roller unit installed on the cover part to match with the printer head unit; and a hinge means having a translational movement area and a rotational area so that the cover part is installed on the main body casing part to be opened and closed through the linear movement and the rotational operation.

Further, for achieving the object, a printer according to another aspect of the present disclosure includes a main body casing part in which a storage part has been formed; a printer head unit installed on the main body casing part; a cover part installed to be openable and closable on the main body casing part; a platen roller unit installed on the cover part to match with the printer head unit; a hinge means having a translational movement area and a rotational area so that the cover part is installed on the main body casing part to be opened and closed through the linear movement and the rotational operation; and an opening and closing means embedded to perform the opening and closing operation of the cover part. Here, the cover part may be configured to include an outer case installed to be openable and closable on the main body casing part; and an inner case installed inside the outer case and connected to the main body casing part. Further, the opening and closing means may be configured to include a slider connected to be ascendable to the inner case; and an elastic member installed between the slider and the outer case to provide the linear movement force, and the slider may be formed in a structure that has a handle part formed at the center of a slider body, has an elastic member insertion groove, an inside slider groove, and an outside slider groove recessed at both sides thereof, and has a lever pressing protrusion protruded from one side end portion thereof.

The elastic member may be formed of a tension coil spring that has one end connected to the lower side of the elastic member insertion groove and has the other end connected to the upper side of the outer case.

Further, the inner case may have an inside slider rail seated in the inside slider groove formed thereon, and the outer case may have an outside slider rail seated in the outside slider groove and a handle operation hole to which the handle part is exposed formed thereon.

Meanwhile, the hinge means may be configured to include a hinge shaft prepared on the cover part and having a linear part performing the translational movement and a curved part performing the rotational operation integrally formed thereon; and a hinge hole prepared in the main body casing part and having a linear movement part in which the linear part moves and a circular part formed integrally on the end portion of the linear movement part so that the curved part turns.

Further, the printer according to the present disclosure may be configured to include a guide means configured to face the cover part and the main body casing part to guide the operation of the hinge means.

Preferably, the guide means may include a guide shaft formed on the main body casing part; and a guide rail formed on the cover part and having a linear movement groove into which the guide shaft is inserted and a curved movement groove recessed to be communicated to the linear movement groove.

A stopper to which the guide shaft is latched may be formed on the end portion of the curved movement groove to control the opening angle of the cover part.

Further, the printer according to the present disclosure may be configured to include an auxiliary guide means configured to face the cover part and the main body casing part to guide the linear movement of the cover part.

Preferably, the auxiliary guide means may include a guide protrusion protruded from the cover part; and a guide groove recessed in the main body casing part so that the guide protrusion is accommodated and slid.

Advantageous Effects

According to the printer according to the present disclosure, it is possible to eliminate the design limiting factor such as the formation position of the hinge part as the opening and closing operation of the cover part is implemented by the translational movement and the rotational operation, thereby minimizing the size of the product and implementing the free design of various forms such as implementing the front feeding and the top feeding of the printing paper at the same time to enhance the merchantability and market competitiveness of the product.

BEST MODE

Figure 1A:
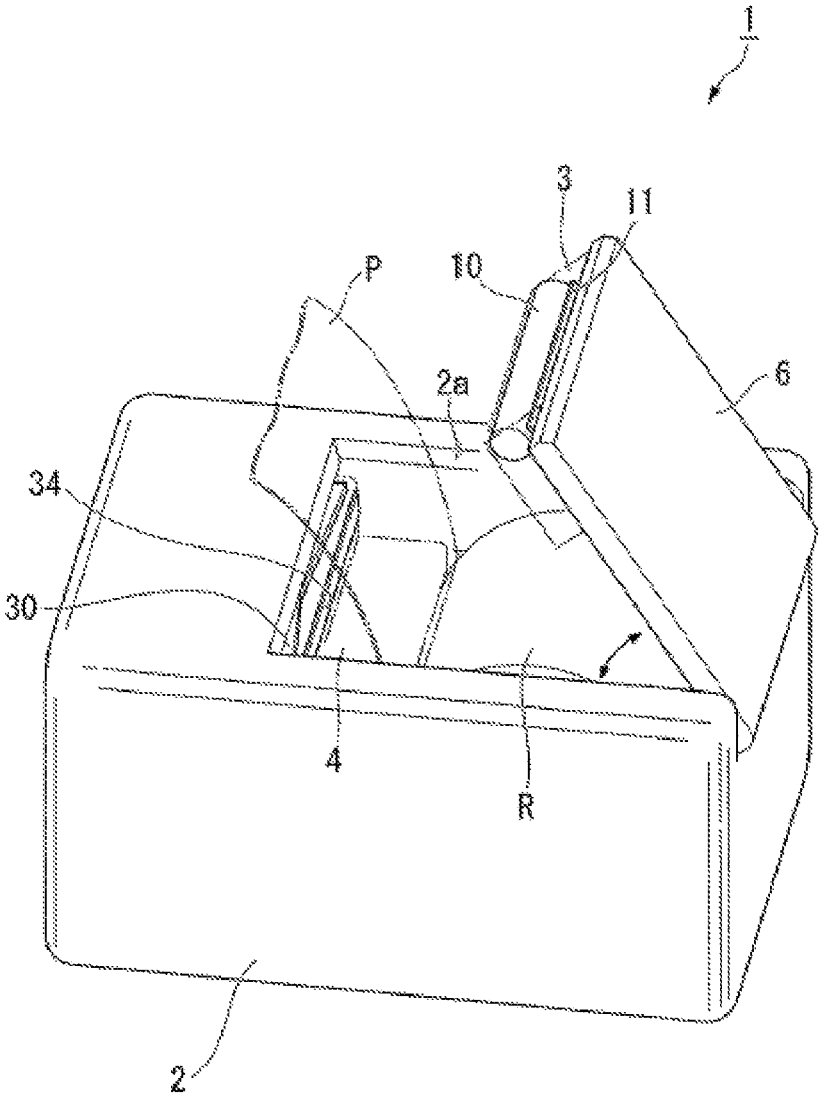
FIG. 1A Prior Art
FIGS. 1A and 1B are diagrams for explaining a conventional printer.
Figure 1B:
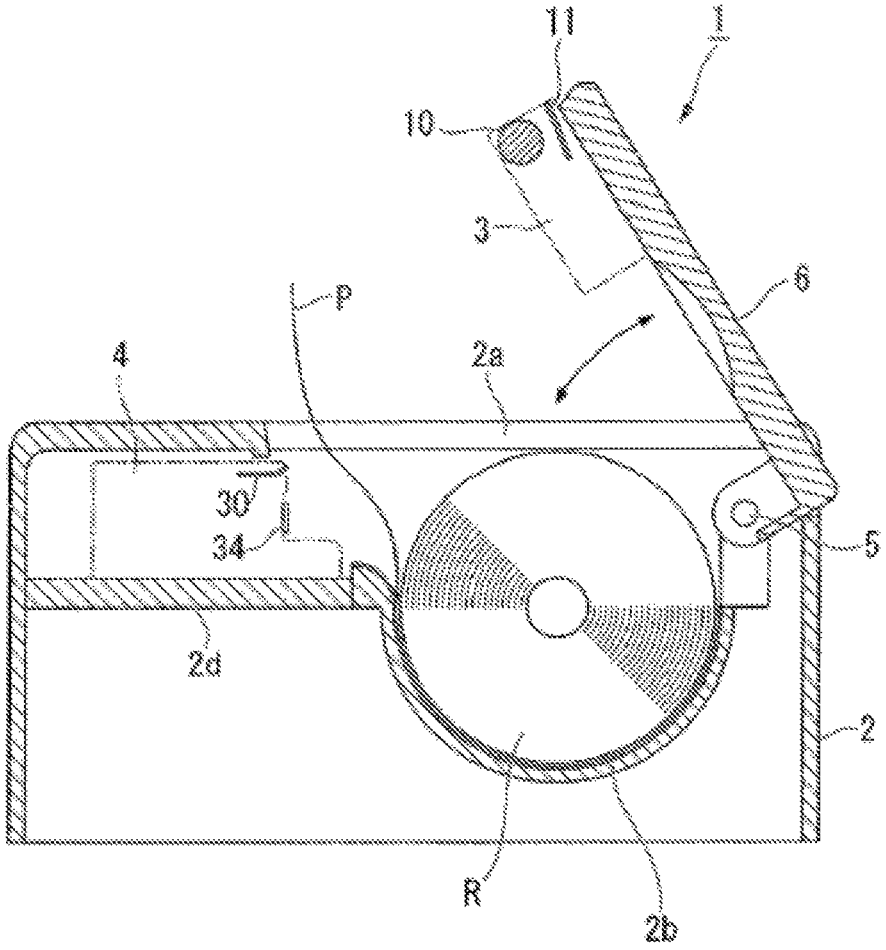
FIG. 1B Prior Art

Hereinafter, preferred embodiments of the present disclosure will be described in detail with reference to FIGS. 2A to 9C, and described by denoting the same elements as the same reference numerals in FIGS. 2A to 9C.

Meanwhile, the detailed description of the configuration and the operation and effect thereof that may be easily understood by those skilled in the art from the general technology in each drawing is simplified or omitted. Further, since the present disclosure has a feature in the opening and closing structure of a cover part, and the parts related thereto will be mainly illustrated and described and the description of the remaining parts will be simplified or omitted.

Figure 2A:
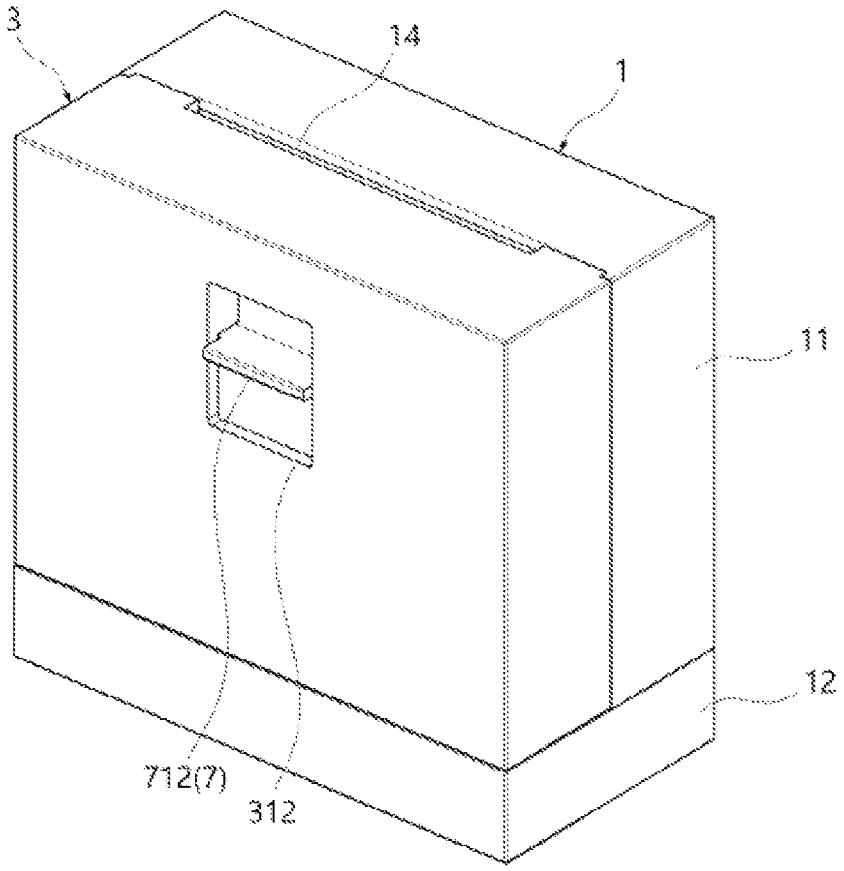
FIGS. 2A to 2C are perspective diagrams illustrating the overall appearance of a printer according to an embodiment of the present disclosure.
Figure 2B:
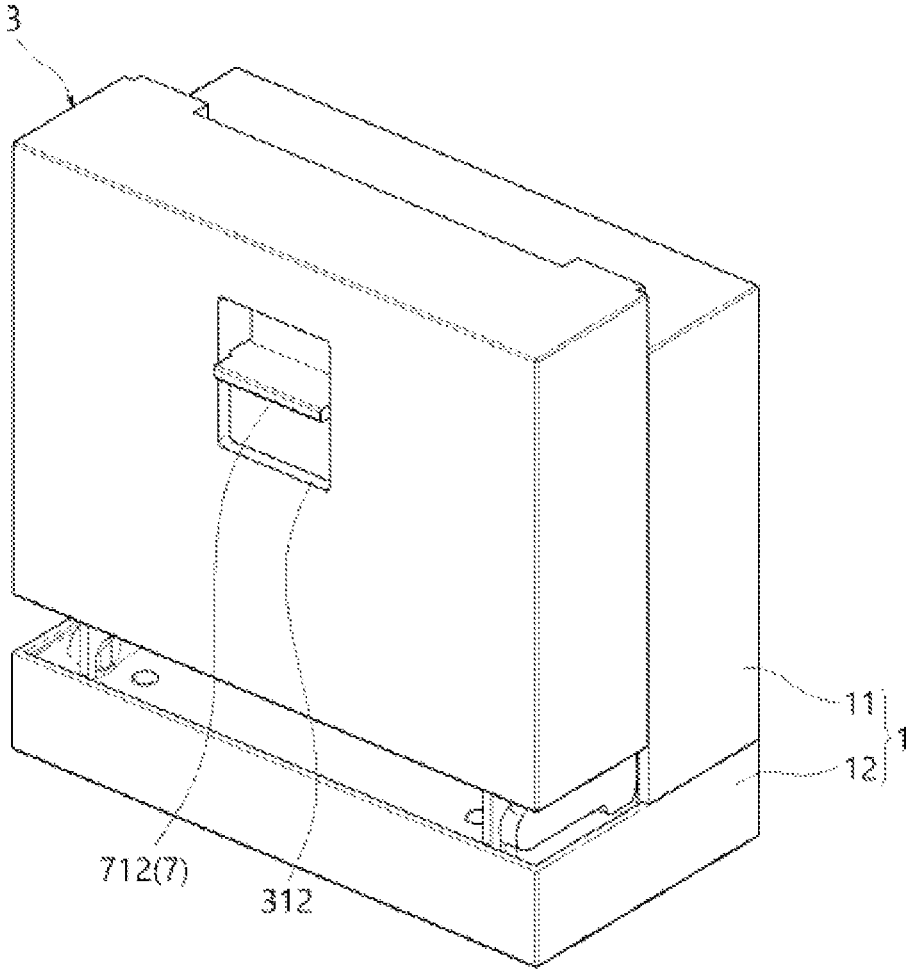
Figure 2C:
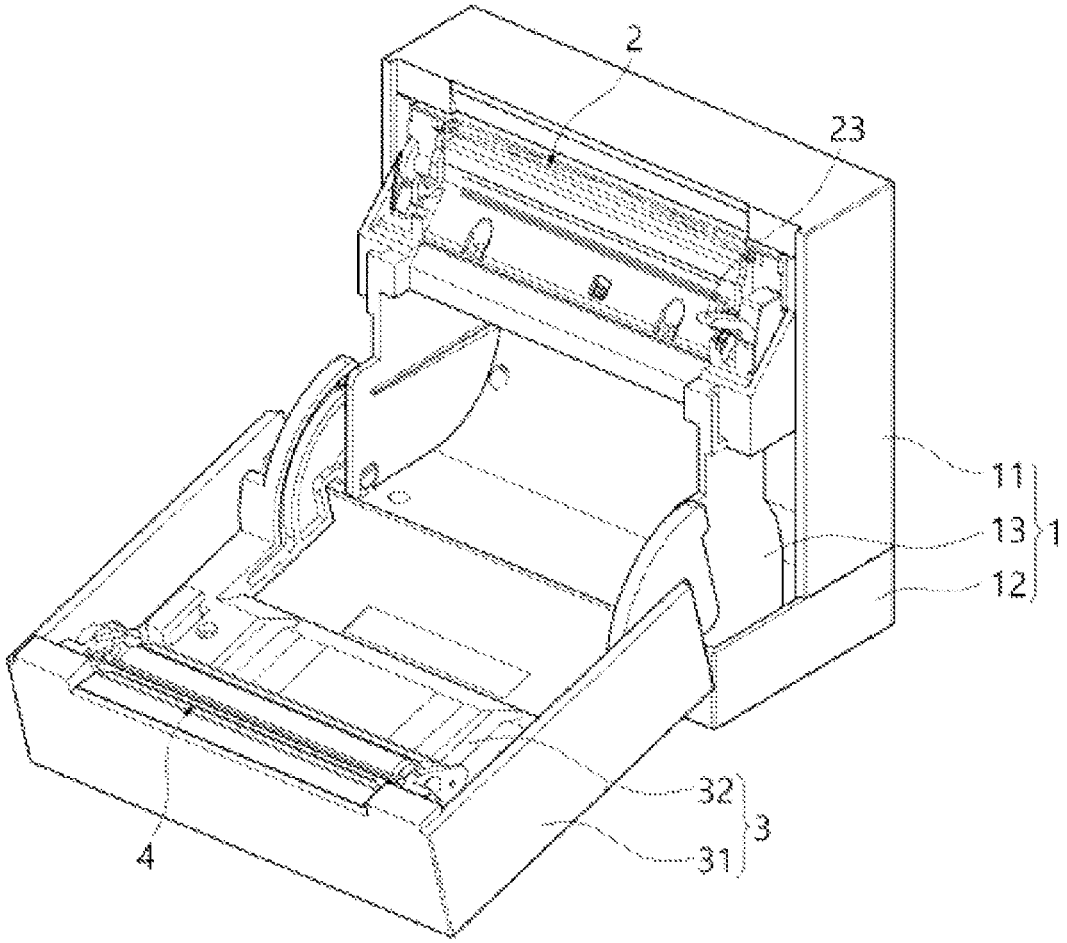
Figure 3:
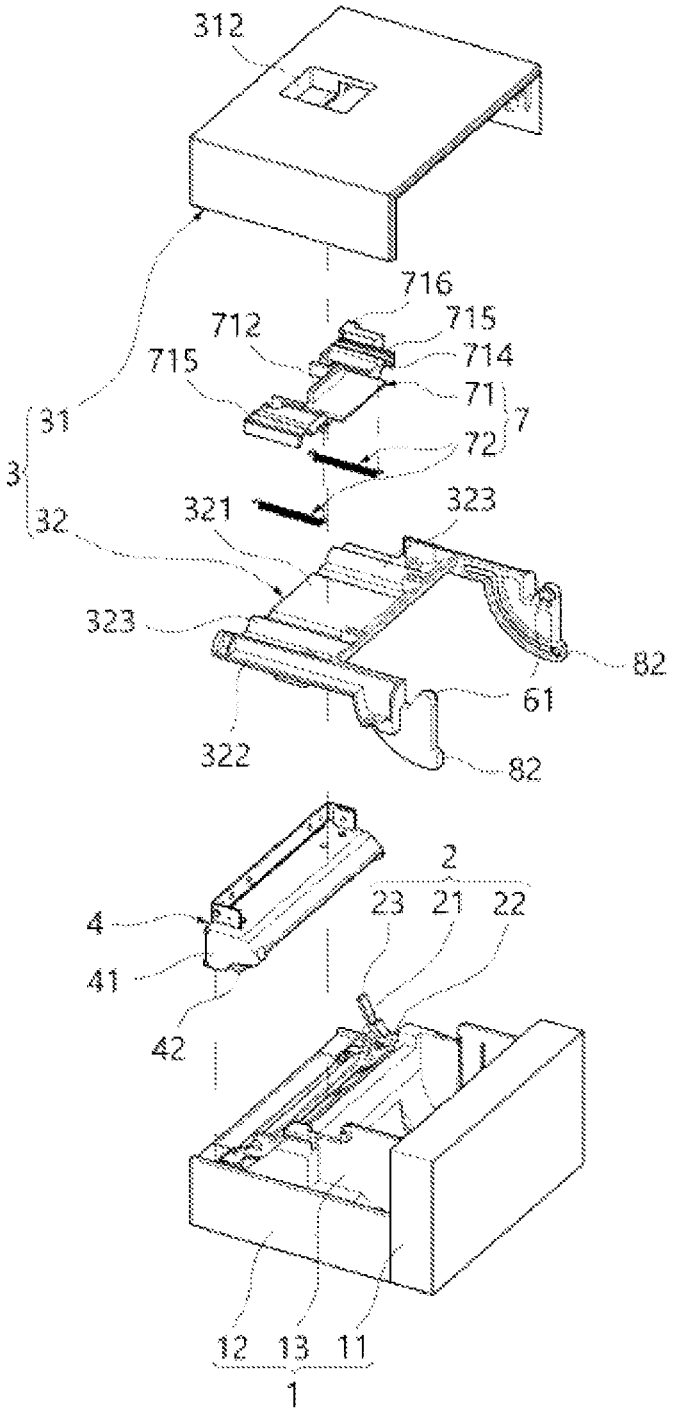
FIG. 3 is an exploded perspective diagram of the printer according to an embodiment of the present disclosure.
Figure 4:
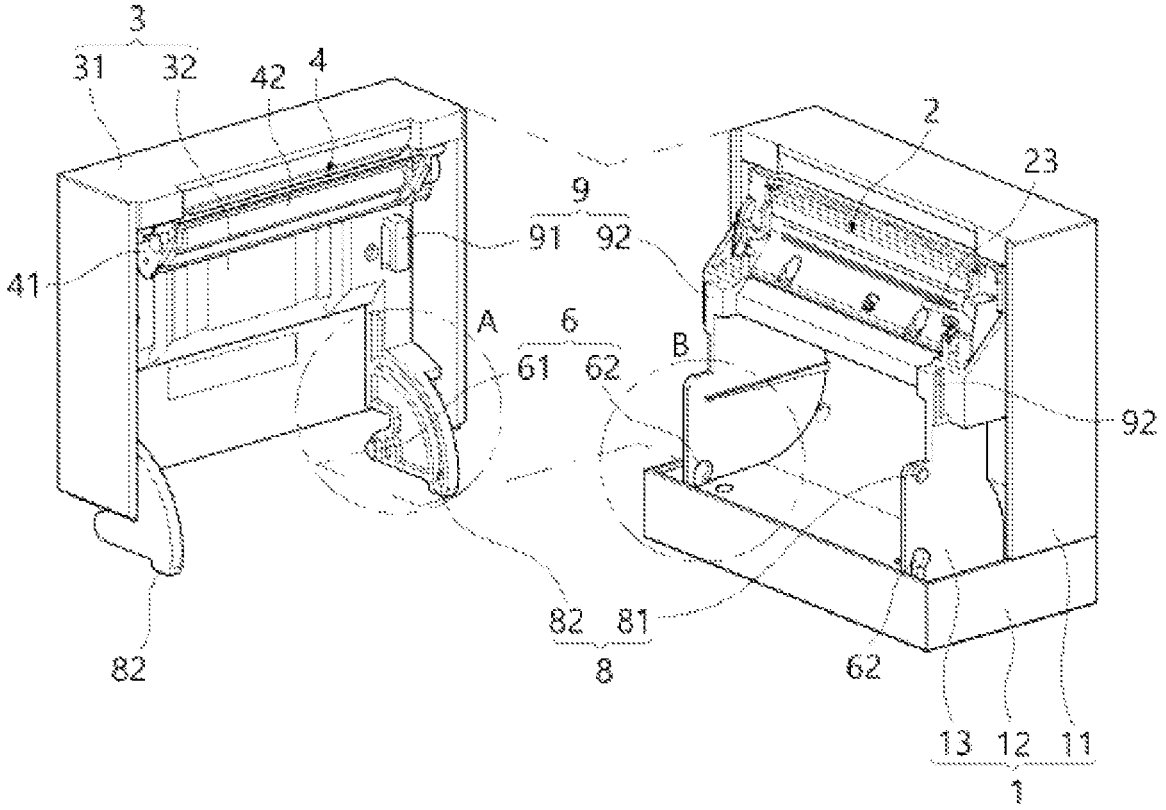
FIG. 4 is an exploded perspective diagram illustrating a state where a cover part of the printer according to an embodiment of the present disclosure has been separated.

FIGS. 2A to 2C are perspective diagrams illustrating the overall appearance of a printer according to an embodiment of the present disclosure: FIG. 2A is a diagram illustrating a state before opening a cover part, FIG. 2B is a diagram illustrating a first phase opening state where the cover part has moved linearly, and FIG. 2C is a diagram illustrating a state where the cover part has moved linearly and then has rotated to be completely opened. FIG. 3 is an exploded perspective diagram of the printer according to an embodiment of the present disclosure, and FIG. 4 is an exploded perspective diagram illustrating a state where the cover part of the printer according to an embodiment of the present disclosure has been separated.

Referring to FIGS. 2A to 4, the printer according to an embodiment of the present disclosure has a main body casing part 1, a printer head unit 2, a cover part 3, a platen roller unit 4, a hinge means 6, and an opening and closing means 7, and as the main feature, is configured to perform the opening and closing operation of the cover part 3 by translational movement and the rotational operation.

The main body casing part 1 is a part of forming a basic appearance of the printer, and is composed of a main case 11 having a substantially rectangular frame shape, a support case 12 formed in a direction orthogonal to one end of the main case, and a main body frame 13 installed with a printer head unit 2 and disposed in the main case 11 and the support case 12 so that a storage part for storing the printing paper, and the like is prepared.

The main case 11, the support case 12, and the main body frame 13 may be formed in a single or a plurality of structures by a material such as synthetic resin, or a metal material, a discharge port 13 through which the printing paper (not illustrated) is discharged is formed on the portion matching with the cover part 3, and a position of the discharge port 13 is not limited thereto and may be changed to various positions to be configured so that the front feeding, the top feeding, and the hybrid type feeding are available.

The printer head unit 2 is a configuration that is installed on the main body frame 13 of the main body casing part 1 and has a thermal printer head 22, a guide roller, and the like provided on a head base 21 to perform a printing operation on the printing paper.

The cover part 3 is a component that is installed to be openable and closable on the main body frame 13 of the main body casing part 1, and is composed of an outer case 31 disposed to face the main case 11, and an inner case 32 disposed in the outer case 31 to be connected to be openable and closable to the main body frame 13.

The outer case 31 is formed in a substantially rectangular barrel shape by a plate-shaped member to close the opening of the main body casing part 1, and is formed in a structure having an opening in which the side wall has been omitted in a direction opposite to the support case 12 to enable the linear movement. Further, the outer case 31 has a handle operation hole 312 perforated so that a handle part 712 to be described later is exposed to the outside, and has an outside slider rail 314, which is seated in an outside slider groove 715 to be described later, protruded from the inner surfaces of both sides of the handle operation hole 312.

The inner case 32 is a component that is connected to the main body casing part 1 to enable the linear movement and the rotational operation, has a structure of having a plate-shaped body 321 and guide posts 322 of a bar form formed at both sides of the plate-shaped body 321. The plate-shaped body 321 has a pair of inside slider rails 323 seated in an inside slider groove 714 of the opening and closing means 7 to be described later on one surface thereof, and the guide posts 322 are formed with a hinge shaft 61 of the hinge means 6 and a guide rail 82 of the guide means 8.

The platen roller unit 4 is a component that is installed inside the cover part 3 to match with the printer head unit 2 in the closed state, and has the platen roller 42, and the like provided on a platen roller base 41 to perform an operation for guiding the printing paper conveyed by a guide roller (not illustrated) of the printer head unit 2 toward the thermal printer head 22.

Figure 5A:
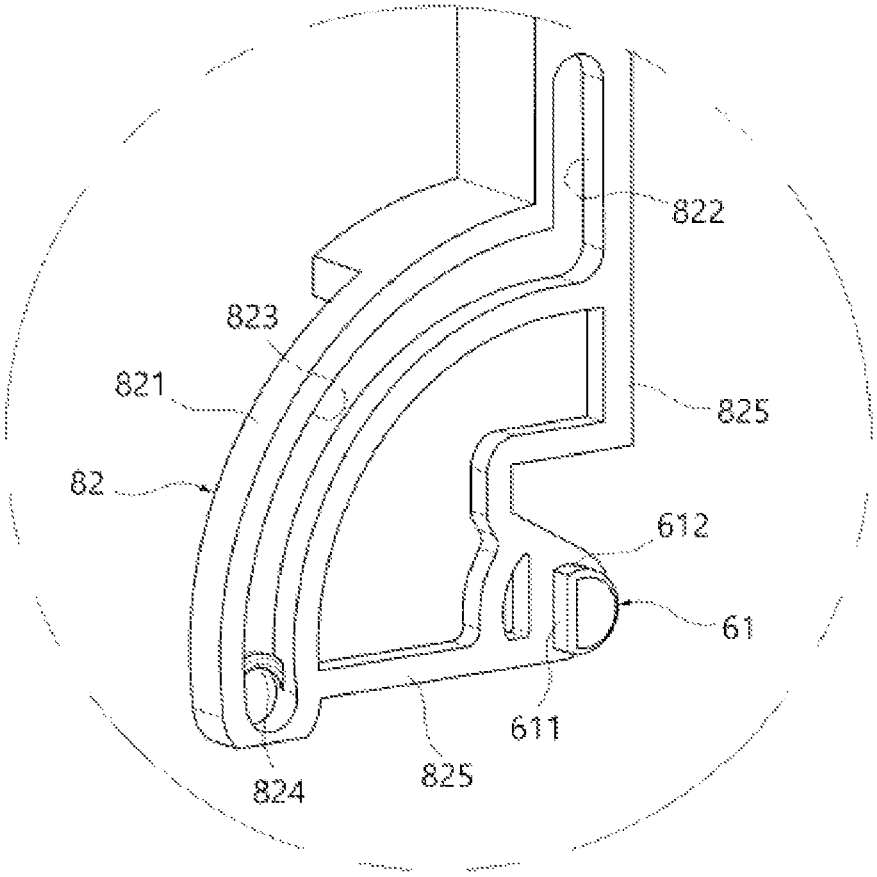
FIGS. 5A and 5B are enlarged perspective diagrams for explaining a hinge means and a guide means of the printer according to an embodiment of the present disclosure.
Figure 5B:
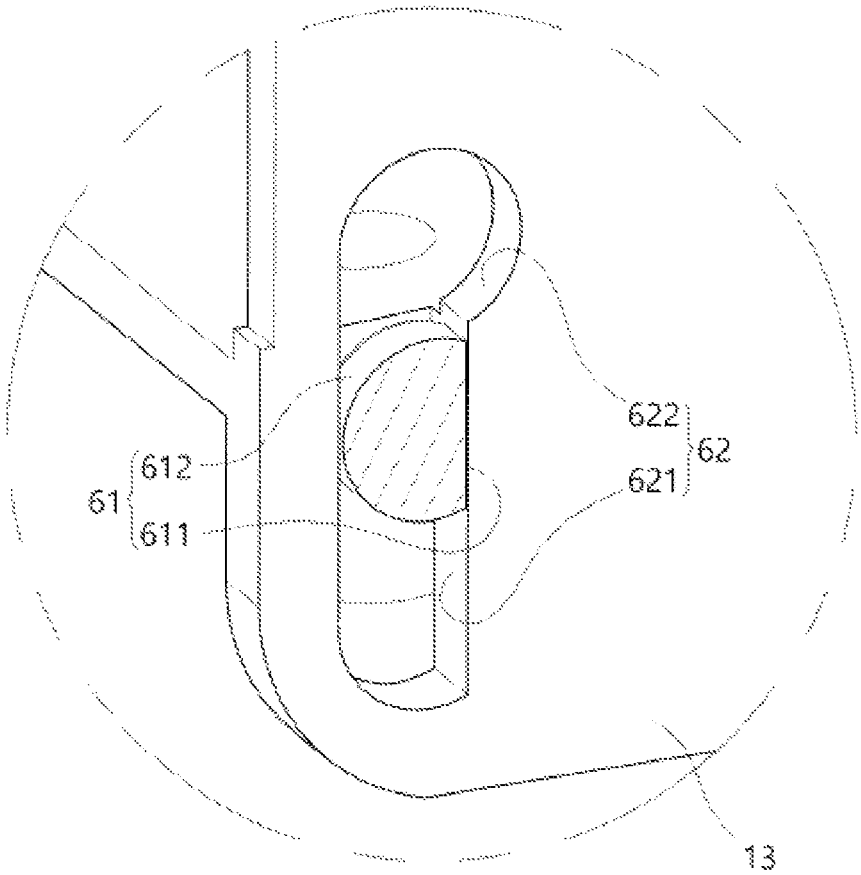

FIGS. 5A and 5B are enlarged perspective diagrams for explaining a hinge means and a guide means of the printer according to an embodiment of the present disclosure: FIG. 5A is an enlarged diagram of a portion A in FIG. 4, FIG. 5B is an enlarged diagram of a portion B in FIG. 4, and FIG. 5B has illustrated a state where the hinge shaft 61 has been inserted into the hinge hole 62.

Referring to FIGS. 3, and 4 to 5B, the hinge means 6 is configured so that the cover part 3 is connected to be opened and closed to the main body casing part 1, and as a main feature, is formed as a structure where the translational movement area and the rotational area have been provided to be opened and closed through the linear movement and the rotational operation.

The hinge means 6 is composed of the hinge shaft 61 formed to be protruded from the lower end of both sides of the inner case 32, and the hinge hole 62 perforated to face both sides of the main body casing part 1 so that the hinge shaft 61 is inserted to perform the linear movement and the rotational operation.

The hinge shaft 61 is formed at the lower end of a guide rail body 821 to be described later, has a structure where a linear part 611 in which the translational movement is performed and the curved surface portion 612 in which the rotational operation is performed have been integrally formed, and is protruded to have the cross-sectional structure of a substantially 'D' shape. Further, the guide rail body 821 is formed with a connecting support part 825 in a direction orthogonal to the formation portion of the hinge shaft 61.

The hinge hole 62 is composed of a linear movement part 621 formed to be perforated in a straight shape so that the linear part 611 of the hinge shaft 61 is moved, and a circular part 622 formed to be connected to the end portion of the linear movement part 621 so that the curved part 622 of the hinge shaft 61 turns.

Further, as in the present embodiment, the hinge means 6 has preferably the hinge shaft 61 and the hinge hole 62 formed integrally with the inner case 32 and the main body frame 13 of the main body casing part 1, respectively, but is not limited thereto, and may also be configured in the form of separately producing and then coupling a member (not illustrated) having the hinge shaft formed thereon and a member (not illustrated) having the hinge hole formed therein if necessary.

Meanwhile, the printer according to an embodiment of the present disclosure constitutes a guide means 8 to face the cover part 3 and the main body casing part 1 to guide the operation of the hinge means 6.

As illustrated in FIGS. 3, 4, and 5A, the guide means 8 is composed of a guide shaft 81 formed on the main frame 13 of the main body casing part 1, and a guide rail 82 formed on the inner case 32 so that the guide shaft 81 is connected.

The guide shaft 81 is formed to be protruded from the side surface of the main body frame 13 in the form of a pin to be positioned at the uppermost end of the linear movement groove 822 to be described later at the closing operation of the cover part 3.

As illustrated in FIG. 5A, the guide rail 82 is formed so that the linear movement groove 822 recessed in a straight shape so that the guide shaft 81 is inserted into the guide rail body 821 protruded in a substantially arc shape at both sides of the inner case 32, and a curved movement groove 823 recessed to be communicated to the linear movement groove 822 form one movement path.

Preferably, the guide rail 82 is formed with a stopper 824 to which the guide shaft 81 is latched at the distal end portion of the curved movement groove 823 to perform the limitation of the opening angle of the cover part 3 and the function of the stopper.

Figure 6:
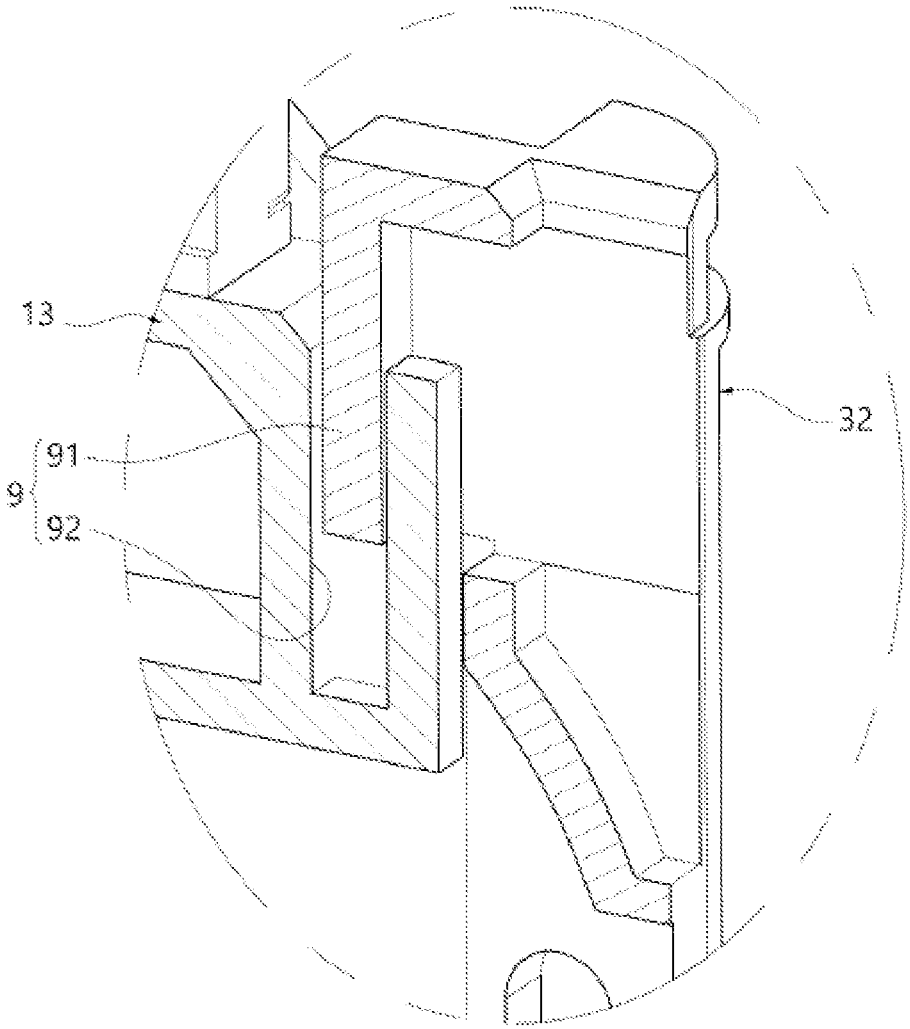
FIG. 6 is an enlarged perspective diagram for explaining an auxiliary guide means of the printer according to an embodiment of the present disclosure.

FIG. 6 is an enlarged perspective diagram for explaining the auxiliary guide means of the printer according to an embodiment of the present disclosure, and illustrates a state where a guide protrusion 91 has been inserted into a guide groove 92.

Referring to FIGS. 4 and 6, the printer according to an embodiment of the present disclosure constitutes an auxiliary guide means 9 to face the cover part 3 and the main body casing part 1 to adjunctively guide the linear movement of the cover part 3.

The auxiliary guide means 9 is composed of the guide protrusions 91 protruded from both sides of the inner case 32, and the guide groove 92 recessed in the main body casing part 1 so that the guide protrusion 91 is accommodated and slid.

Further, if the auxiliary guide means 9 may guide the linear movement of the cover part 3, it may be configured variously without particular limitation to the formation position or structure of the guide protrusion and the guide groove, but in the present embodiment, the guide groove 92 is formed as a straight-shaped groove at the upper side contacting the guide shaft 81, and the guide protrusion 91 is formed as a straight-shaped protrusion at both sides of the facing inner case 32. At this time, the guide protrusion 91 is formed in a cross-sectional structure of the '¬' shape so that the protrusion inserted into the guide groove 92 is prepared.

Figure 7A:
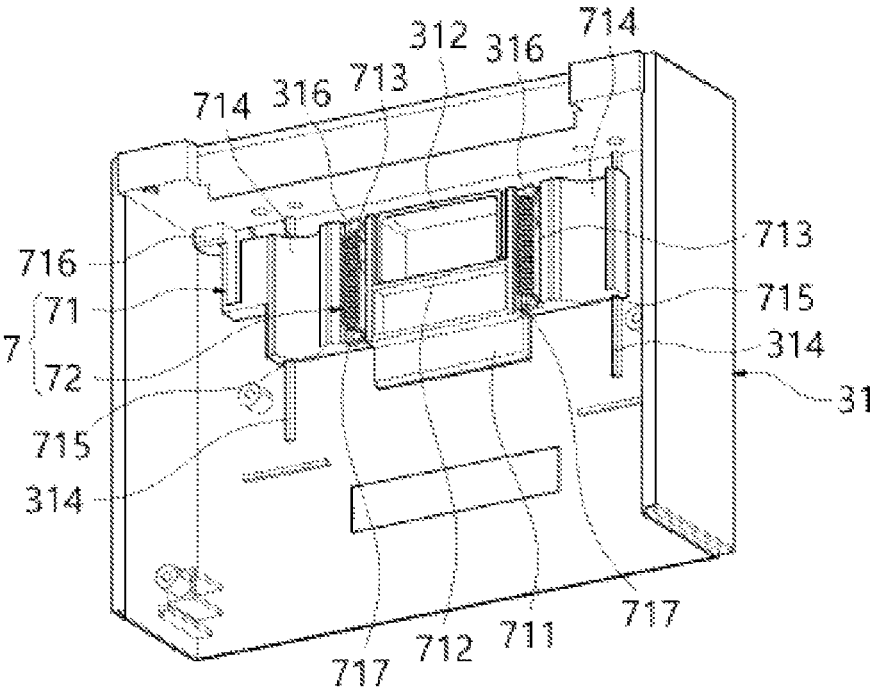
FIGS. 7A and 7B are diagrams for explaining an opening and closing means of the printer according to an embodiment of the present disclosure.
Figure 7B:
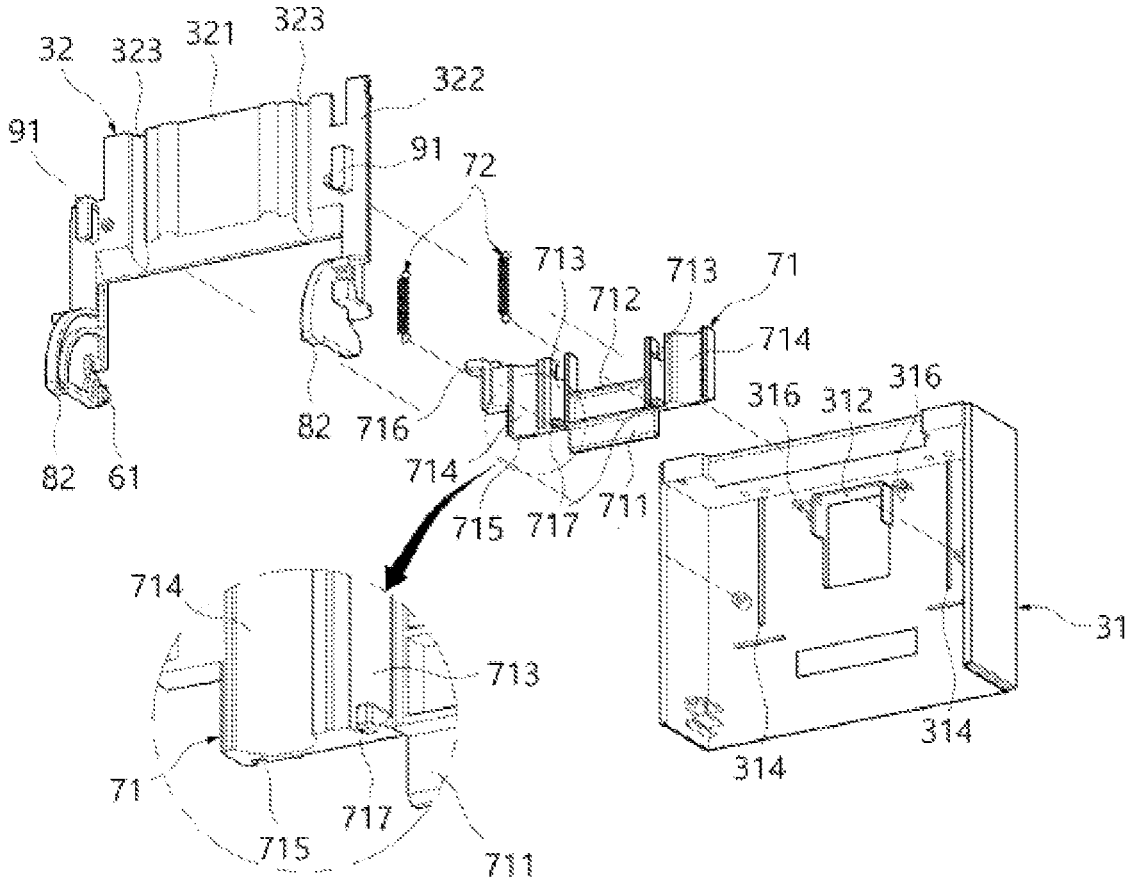

FIGS. 7A and 7B are diagrams for explaining the opening and closing means of the printer according to an embodiment of the present disclosure: FIG. 7A is a perspective diagram illustrating a state where the opening and closing means has been assembled, and FIG. 7B is an exploded perspective diagram illustrating a state where the opening and closing means has been separated.

Referring to FIGS. 3, 7A, and 7B, the opening and closing means 7 is a component that is embedded in the cover part 3 to perform the opening and closing operation and is composed of a slider 71 and an elastic member 72.

The slider 71 is a member that is connected to be ascendable between the outer case 31 and the inner case 32, has the handle part 712 formed at the center of the slider body 711 slidably connected to the inner case 32, has an elastic member insertion groove 713, into which the elastic member 72 is inserted, recessed at both sides contacting the handle part 712, and has the inside slider groove 714 recessed in contact with the elastic member insertion groove 713.

Further, the slider 71 has the outside slider insertion groove 715, which is seated in the outside slider rail 314 formed on the outer case 31, formed on the outer surface of the slider body 711 contacting the inside slider groove 714, and has a lever pressing protrusion 716 for pressing a lever 23 provided on the printer head unit 2 formed on one side end portion of the slider body 711 contacting the outside slider insertion groove 715. Further, a latching protrusion 717 to which the lower side portion of the elastic member 72 is latched is protruded from the lower side of the elastic member insertion groove 713.

The elastic member 72 is a component that is installed between the slider 71 and the outer case 31 to provide the linear movement force for ascending the cover part 3, and may be configured without particular limitation to the shape or the structure if the ascending force may be applied, but in this embodiment, is formed of a tension coil spring having one end connected to the latching protrusion 717 prepared at the lower side of the elastic member insertion groove 713 and having the other end connected to a latching protrusion 316 prepared at the upper side of the outer case 31.

Figure 8A:
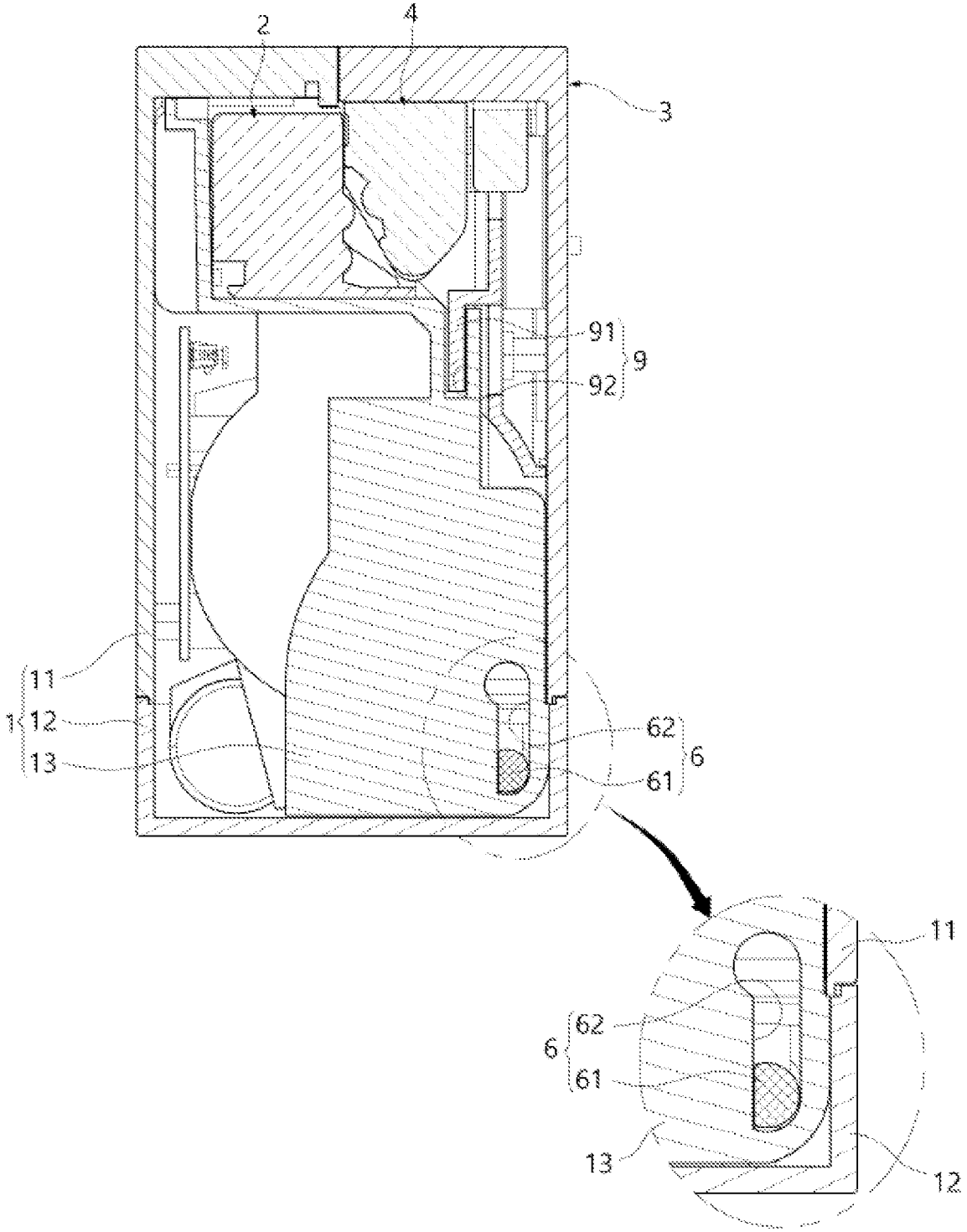
FIGS. 8A to 8C are diagrams for explaining an operation of the hinge means at the opening and closing operation of the printer according to an embodiment of the present disclosure.
Figure 8B:
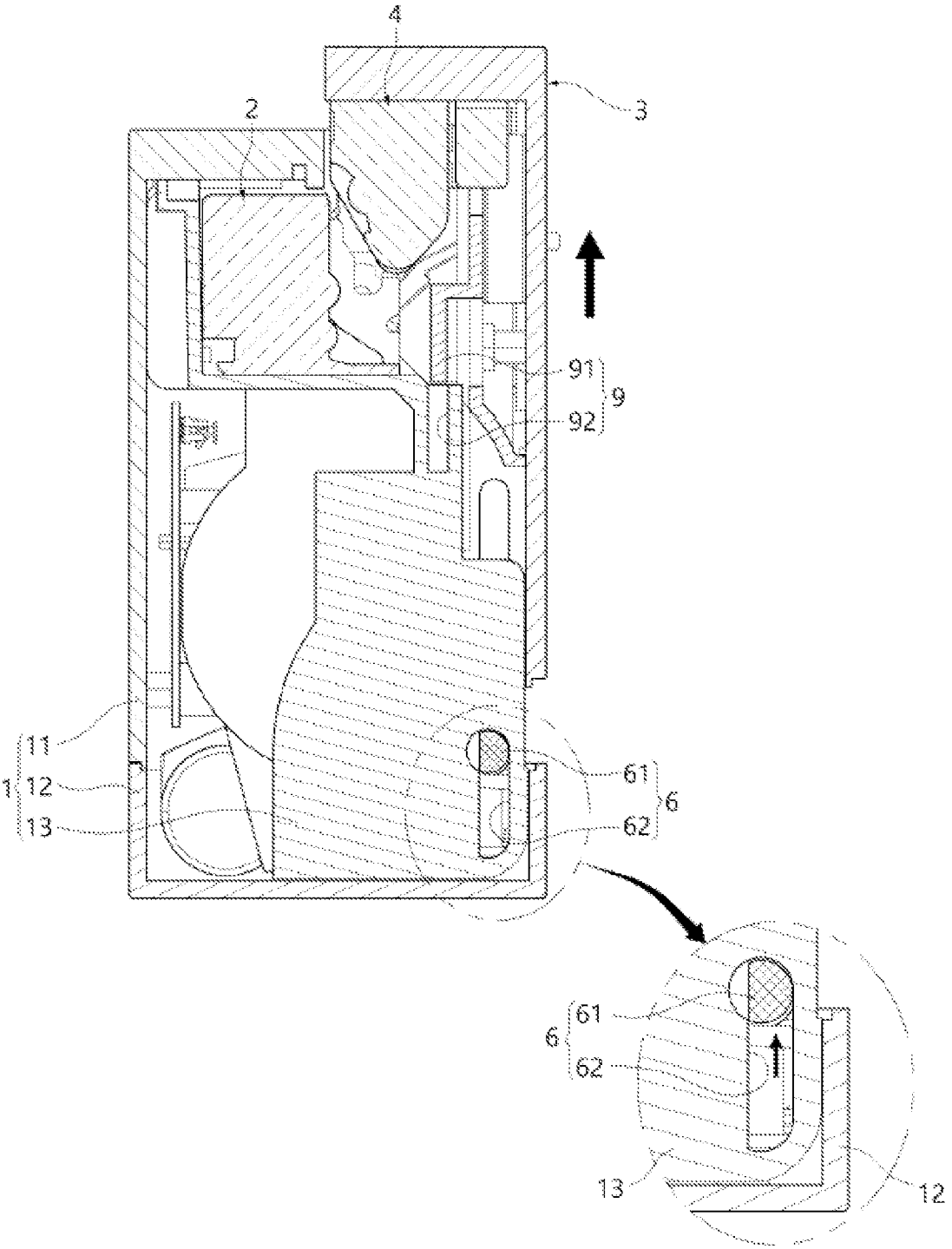
Figure 8C:
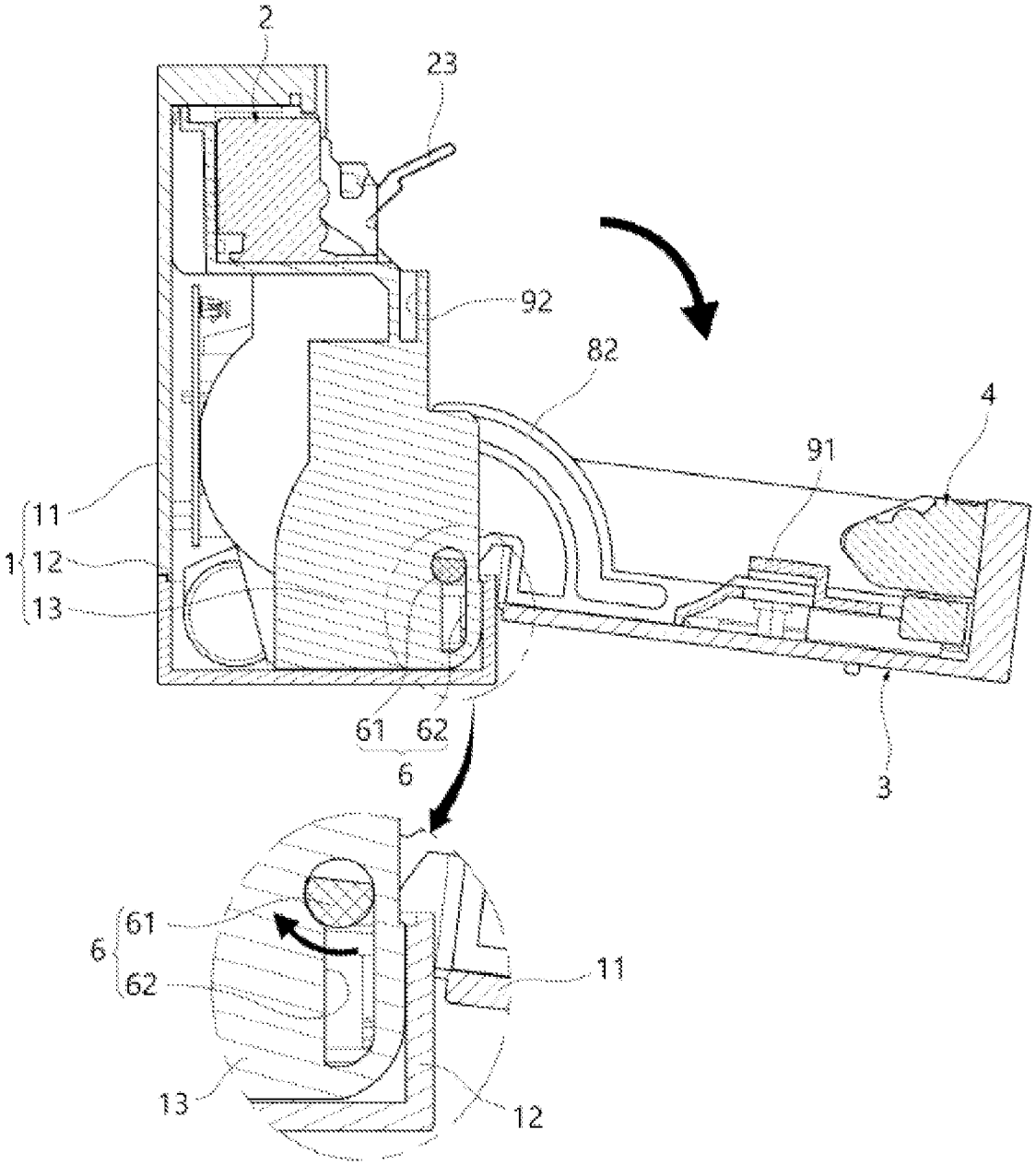

FIGS. 8A to 8C are diagrams for explaining the operation of the hinge means at the opening and closing operation of the printer according to an embodiment of the present disclosure: FIG. 8A illustrates the position and shape of the hinge shaft in a state where the cover part has been closed, FIG. 8B illustrates the position and shape of the hinge shaft in a state where the cover part has moved linearly, and FIG. 8C illustrates the position and shape of the hinge means at the rotational operation of the cover part.

Figure 9A:
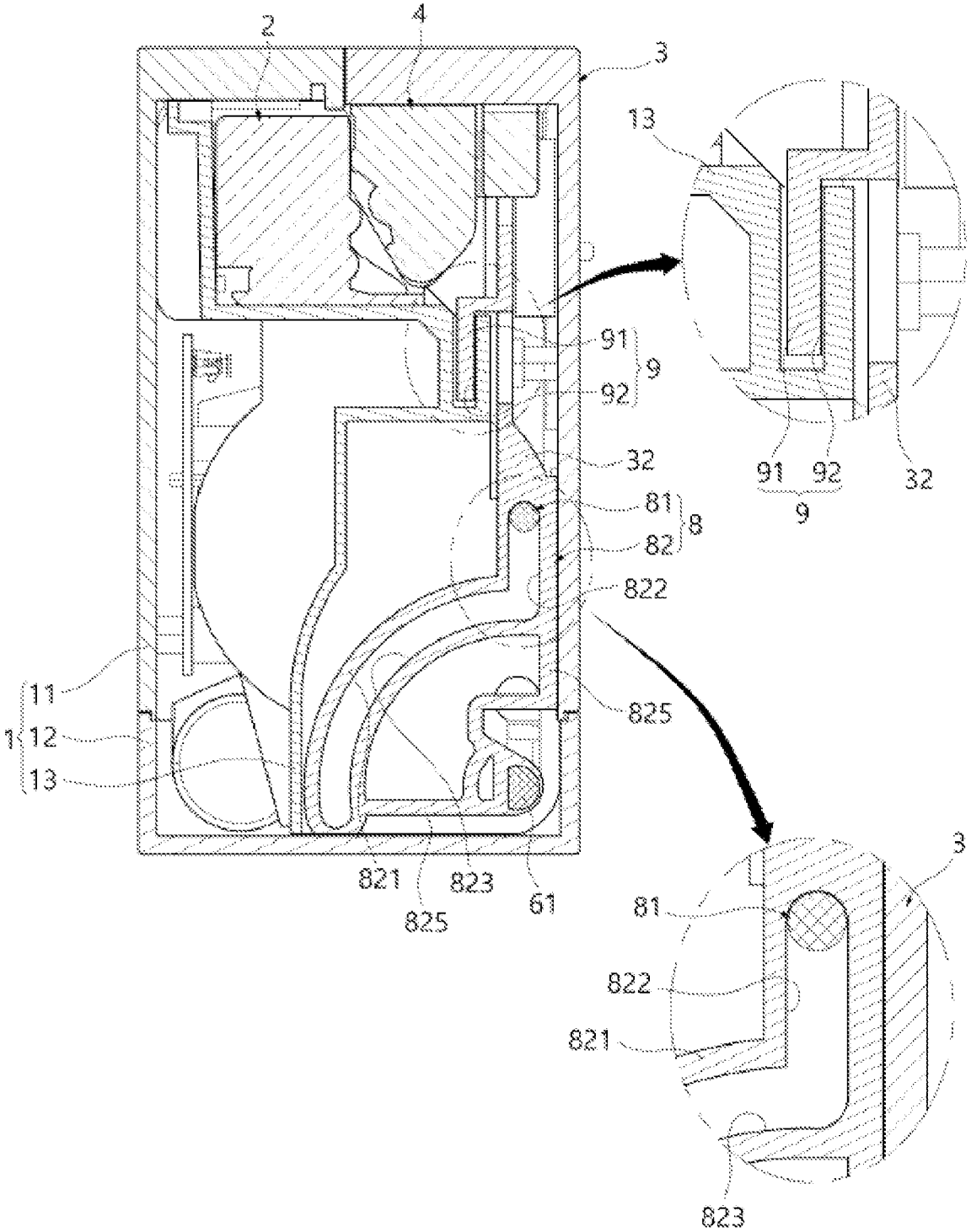
FIGS. 9A to 9C are diagrams for explaining an operation of the guide means and the auxiliary guide means at the opening and closing operation of the printer according to an embodiment of the present disclosure.
Figure 9B:
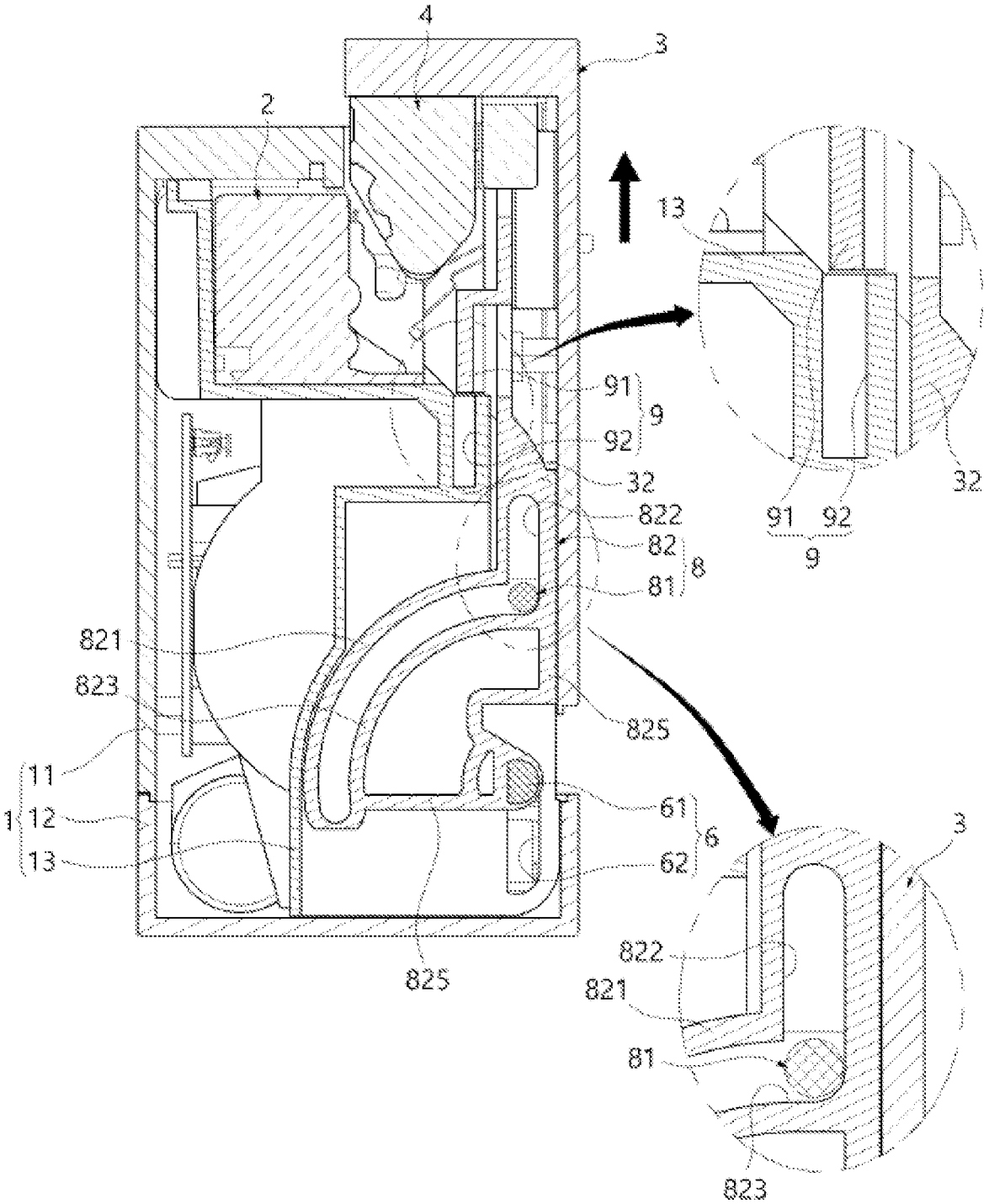
Figure 9C:
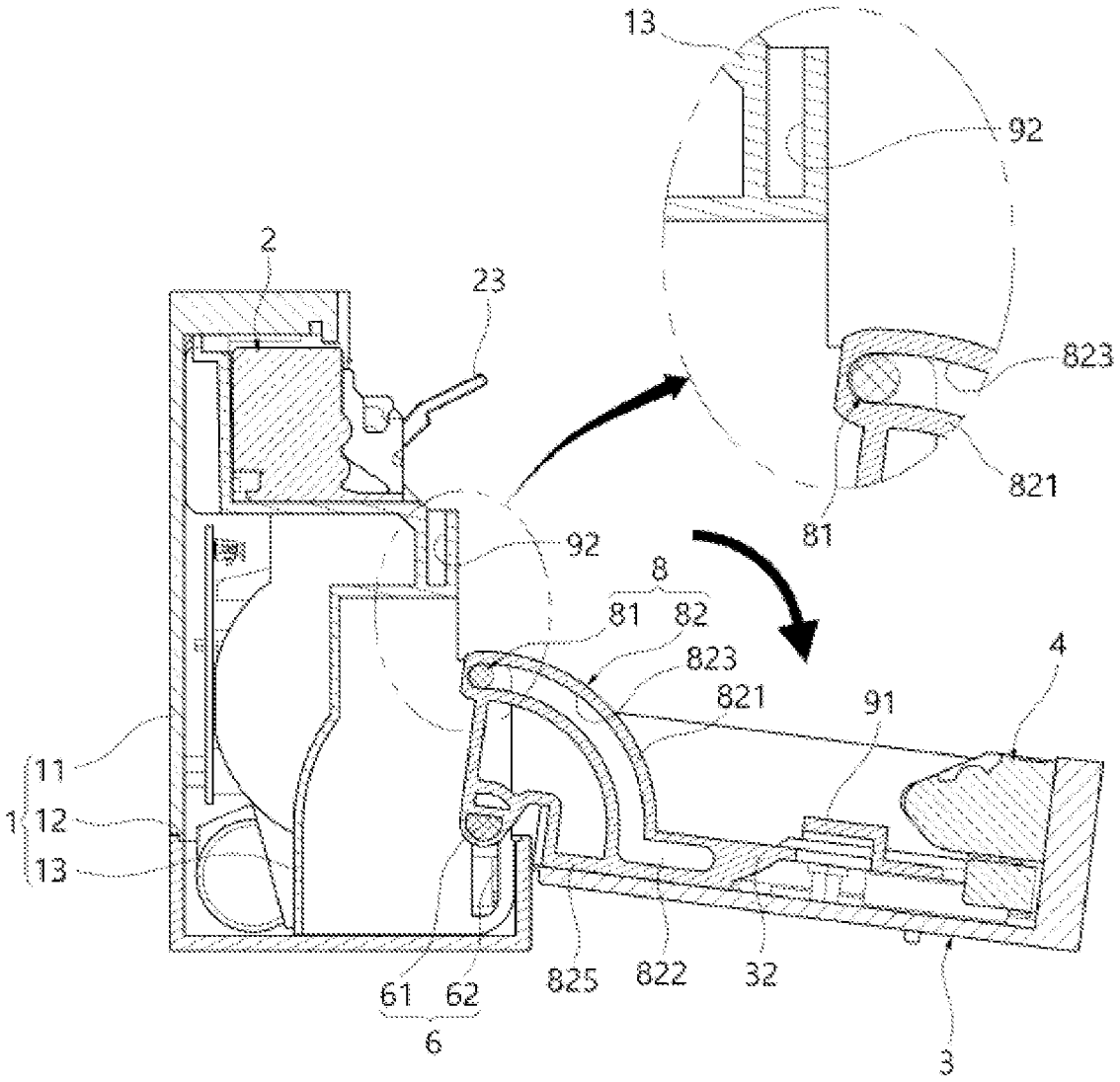

FIGS. 9A to 9C are diagrams for explaining the operation of the guide means and the auxiliary guide means at the opening and closing operation of the printer according to an embodiment of the present disclosure: FIG. 9A illustrates the positions and shapes of the guide means and the auxiliary guide means in a state where the cover part has been closed, FIG. 9B illustrates the position and shape in a state where the cover part has moved linearly, and FIG. 9C illustrates the position and shape at the rotational operation of the cover part.

Further, FIGS. 8A to 9C are cross-sectional diagrams simplifying or omitting some portions of the printer in order to facilitate understanding of the present disclosure and an operation of the printer according to an embodiment of the present disclosure will be briefly described with reference to FIGS. 8A to 9C.

As illustrated in FIG. 8A, if the handle part 712 of the opening and closing means 7 is pressed to replace or maintain the printing paper in the process of positioning the printer at the installation place to be used for printing a receipt, a specification, or the like, the lever pressing protrusion 716 presses the lever 23 of the printer head unit 2 while the slider 71 descends together with the inflation of the elastic member 72, such that the coupled state of the platen roller unit 4 and the printer head unit 2 coupled to the inner surface of the cover part 3 is released.

If the release operation together with the pressing operation of the handle part 712 is performed, the cover part 3 performs the linear motion upward by the elastic restoring force of the elastic member 72, as illustrated in FIG. 8B.

In explaining the upward movement of the cover part 3 in more detail, if the ascending force is applied to the inner case 32 while the elastic member 72 is elastically restored, the hinge shafts 61 of both ends of the lower side thereof are ascended along the hinge hole 62. That is, as illustrated in the enlarged portion in FIG. 8A, the hinge shaft 61 positioned at the lowermost side of the hinge hole 62 is ascended in the form illustrated in the enlarged portion in FIG. 8B. At this time, since the linear part 611 of the hinge shaft 61 is guided and ascended by the linear movement part 621 of the hinge hole 62, the rotational operation is not performed and the linear motion is performed.

The guide means 8 and the auxiliary guide means 9 at the ascending operation of the cover part 3 allows a more smooth linear motion to be performed through the guide operation. That is, as illustrated in the enlarged portions of FIGS. 9A and 9B, the guide shaft 81 guides the linear movement to the point where the stroke distance of the linear movement groove 822 is completed at the ascending operation of the cover part 3 while the guide protrusion 91 of the auxiliary guide means 9 may adjunctively guide the linear motion while sliding along the guide groove 92, thereby performing a more stable linear motion. Further, the guide means 8 and the auxiliary guide means 9 perform the function of controlling to enable the rotational operation only at the point where the linear motion has been completed while guiding the linear motion of the cover part 3, thereby strengthening the reliability of the opening and closing operation of the cover part 3 and exerting the ascending operation that prevents a problem caused by deviation or malfunction in advance.

Meanwhile, if the linear movement of the cover part 3 is completed to apply the rotational force to the cover part 3, as illustrated in FIG. 9C, the cover part 3 performs the rotational motion along the arc-shaped path of the curved movement groove 823 by the interaction with the guide shaft 81.

Further, the stopper 824 to which the guide shaft 81 is latched may be provided on the end portion of the curved movement groove 823 of the guide rail 82 to perform the function of the stopper capable of limiting the opening angle of the cover part 3, thereby enhancing ease of use and safety.

Further, since the closing operation of the cover part 3 in the printer according to an embodiment of the present disclosure is performed identically or similarly by the reverse operation of the hinge means 6, the guide means 8, and the auxiliary guide means 9 described above, a detailed description thereof will be omitted.

Further, the printer according to an embodiment of the present disclosure may also constitute separately and install a cover part rotational means (not illustrated) for allowing the rotational operation to be automatically performed if the movement of the linear section is completed at the opening of the cover part 3.

Although the configuration and operation of the printer according to an embodiment of the present disclosure described above have been described, this is merely illustrative and it will be understood by those skilled in the art that a portion of the above-described embodiment may be substituted and modified without departing from the technical spirit of the present disclosure.

Therefore, it should be understood that the protection scope of the present disclosure affects the disclosure recited in the claims and equivalents thereof.

What is claimed is:

1. A printer, comprising:

a main body having a storage space therein;

a printer head disposed in the main body;

a cover assembly coupled to the main body and capable of being opened or closed with respect to the main body;

a platen roller disposed in the cover assembly to match with the printer head;

a hinge assembly configured to allow the cover assembly to linearly and rotationally move with respect to the main body so that the cover assembly is opened or closed with respect to the main body through linear movement and rotational movement thereof; and an opening and closing assembly configured to perform opening and closing operations of the cover assembly, wherein the cover assembly comprises:

an outer case configured to be opened or closed with respect to the main body; and an inner case disposed inside the outer case and coupled to the main body.

2. The printer of claim 1, wherein the opening and closing assembly comprises:

a slider connected to the inner case and capable of being ascended or descended; and an elastic member disposed between the slider and the outer case to provide force for the linear movement.

3. The printer of claim 2, wherein the slider comprises:

a slider body slidably connected to the inner case;

a handle formed at a center of the slider body;

an elastic member insertion groove, in which the elastic member is seated, and disposed adjacent to the slider body;

an inside slider groove disposed adjacent to the elastic member insertion groove;

an outside slider groove disposed adjacent to the inside slider groove; and a lever pressing protrusion protruded from one side end portion of the slider.

4. The printer of claim 3, wherein the elastic member of includes a tension coil spring that has one end connected to a lower side of the elastic member insertion groove and has another end connected to an upper side of the outer case.

5. The printer of claim 3, wherein the inner case has an inside slider rail seated in the inside slider groove.

6. The printer of claim 3, wherein the outer case has an outside slider rail seated in the outside slider groove and a handle operation hole through which the handle is exposed.

7. The printer of claim 1, further comprising:

an auxiliary guide assembly configured to guide the linear movement of the cover assembly.

8. The printer of claim 7, wherein the auxiliary guide assembly comprises:

a guide protrusion protruded from the cover assembly; and a guide groove recessed in the main body such that the guide protrusion is slidably accommodated therein.

9. A printer, comprising:

a main body having a storage space therein;

a printer head disposed in the main body;

a cover assembly coupled to the main body and capable of being opened or closed with respect to the main body;

a platen roller disposed in the cover assembly to match with the printer head; and a hinge assembly configured to allow the cover assembly to linearly and rotationally move with respect to the main body so that the cover assembly is opened or closed with respect to the main body through linear movement and rotational movement thereof, wherein the hinge assembly comprises:

a hinge shaft disposed on the cover assembly and having a linear surface configured to allow the linear movement of the cover assembly and a curved surface configured to allow the rotational movement of the cover assembly; and a hinge hole formed on the main body and having a linear hole in which the linear surface of the hinge shaft is configured to move and a circular hole formed integrally with the linear hole in which the curved surface of the hinge shaft is configured to rotate.

10. A printer, comprising:

a main body having a storage space therein;

a printer head disposed in the main body;

a cover assembly coupled to the main body and capable of being opened or closed with respect to the main body;

a platen roller disposed in the cover assembly to match with the printer head;

a hinge assembly configured to allow the cover assembly to linearly and rotationally move with respect to the main body so that the cover assembly is opened or closed with respect to the main body through linear movement and rotational movement thereof; and a guide assembly configured to guide operation of the hinge assembly, wherein the guide assembly comprises:

a guide shaft disposed on the main body; and a guide rail formed on the cover assembly and having a linear groove into which the guide shaft is configured to be inserted and a curved groove recessed to be communicated with the linear movement groove.

11. The printer of claim 10, wherein the guide assembly further comprises:

a stopper formed on an end portion of the curved groove to restrict an opening angle of the cover assembly.

* * * * *